US012171298B2

(12) United States Patent
Engell

(10) Patent No.: US 12,171,298 B2
(45) Date of Patent: Dec. 24, 2024

(54) SHOE WITH SOLE PROVIDING A DYNAMIC FOOT ARCH SUPPORT

(71) Applicant: GAITLINE AS, Oslo (NO)

(72) Inventor: Håvard Engell, Oslo (NO)

(73) Assignee: GAITLINE AS, Oslo (NO)

( * ) Notice: Subject to any disclaimer, the term of this patent is extended or adjusted under 35 U.S.C. 154(b) by 193 days.

(21) Appl. No.: 17/781,420

(22) PCT Filed: Nov. 13, 2020

(86) PCT No.: PCT/NO2020/050279
§ 371 (c)(1),
(2) Date: Jun. 1, 2022

(87) PCT Pub. No.: WO2021/112683
PCT Pub. Date: Jun. 10, 2021

(65) Prior Publication Data

US 2023/0018039 A1 Jan. 19, 2023

(30) Foreign Application Priority Data

Dec. 6, 2019 (NO) ..... 20191442

(51) Int. Cl.
*A43B 13/12* (2006.01)
*A43B 7/142* (2022.01)
(Continued)

(52) U.S. Cl.
CPC ..... *A43B 13/127* (2013.01); *A43B 7/142* (2013.01); *A43B 13/04* (2013.01); *A43B 13/145* (2013.01); *A43B 13/188* (2013.01)

(58) Field of Classification Search
CPC ..... A43B 7/19; A43B 7/24; A43B 13/125; A43B 13/127; A43B 13/145; A43B 13/188
See application file for complete search history.

(56) References Cited

U.S. PATENT DOCUMENTS 4,241,523 A * 12/1980 Daswick ..... A43B 13/181 36/32 R
4,348,821 A * 9/1982 Daswick ..... A43B 13/24 36/114
(Continued)

FOREIGN PATENT DOCUMENTS

| | | | |
|---|---|---|---|
| EP | 2747592 | B1 | 11/2018 |
| KR | 100807362 | B1 | 3/2008 |
| WO | WO-2009010078 | A1 | 1/2009 |

OTHER PUBLICATIONS

Rustad, Hege; International Search Report; PCT/NO2020/050278; dated Jan. 28, 2021; 3 pages.
(Continued)

*Primary Examiner* — Sharon M Prange
(74) *Attorney, Agent, or Firm* — Bradley Arant Boult Cummings LLP

(57) ABSTRACT

The invention provides a shoe (1) with a sole providing a dynamic foot arch support, the shoe comprising a rubber outsole (9) and an upper (10), the shoe further comprises a midsole (2), the midsole comprising a harder elastic material (4), a softer elastic material (5), wherein the harder elastic material has elastic hardness in a range 1.3 to 3 times higher than the softer elastic material. The shoe is distinguished in that the harder elastic material is arranged in a band (3) inside the periphery of the midsole, wherein the softer elastic material (5) is arranged in the midsole inside the band of the harder elastic material, and the shoe further comprises: a support structure (8) arranged below the softer elastic material in direction medial to lateral and positioned from vertically below to 4 cm in front of the naviculare bone center of a typical user with feet fitting the shoe size, wherein the support structure has higher elastic hardness than the harder elastic material, with a larger vertical dimension medial compared to lateral as seen with the shoe
(Continued)

standing on a horizontal surface, providing increased support under the medial side of the foot arch compared to the lateral side of the foot arch.

10 Claims, 7 Drawing Sheets

(51) Int. Cl.

| | |
|---|---|
| ***A43B 13/04*** | (2006.01) |
| ***A43B 13/14*** | (2006.01) |
| ***A43B 13/18*** | (2006.01) |

(56) References Cited

U.S. PATENT DOCUMENTS

| | | | | |
|---|---|---|---|---|
| 4,399,620 | A * | 8/1983 | Funck | B29D 35/14 36/28 |
| 4,439,937 | A | 4/1984 | Daswick | |
| 4,654,983 | A * | 4/1987 | Graham | A43B 13/12 36/114 |
| 5,141,578 | A * | 8/1992 | Yang | B29D 35/142 264/46.4 |
| 5,185,943 | A | 2/1993 | Tong et al. | |
| 5,579,591 | A * | 12/1996 | Kousaka | A43B 13/143 36/31 |
| 6,119,373 | A | 9/2000 | Gebhard et al. | |
| 7,200,955 | B2 * | 4/2007 | Foxen | A43B 7/1445 36/31 |
| 7,421,808 | B2 | 9/2008 | Baier et al. | |
| 8,196,316 | B2 | 6/2012 | Cook et al. | |
| 8,448,352 | B2 | 5/2013 | Ryu | |
| 8,959,798 | B2 * | 2/2015 | Pfister | A43B 13/125 36/25 R |
| 2005/0034328 | A1 | 2/2005 | Geer | |
| 2006/0137228 | A1 | 6/2006 | Kubo et al. | |
| 2007/0107258 | A1 | 5/2007 | Umezawa et al. | |
| 2008/0127515 | A1 * | 6/2008 | Lohrer | A43B 13/145 36/43 |
| 2009/0183393 | A1 | 7/2009 | Lee | |
| 2010/0192416 | A1 * | 8/2010 | Rees | A43B 7/00 36/103 |
| 2011/0185590 | A1 | 8/2011 | Nishiwaki et al. | |
| 2014/0059883 | A1 | 3/2014 | Adeagbo et al. | |
| 2018/0027923 | A1 | 2/2018 | Iuchi et al. | |
| 2018/0199665 | A1 | 7/2018 | Luedecke et al. | |
| 2021/0267306 | A1 | 9/2021 | Sakaguchi et al. | |
| 2023/0011311 | A1 * | 1/2023 | Engell | A43B 7/142 |
| 2023/0309647 | A1 * | 10/2023 | Archuleta | A43B 7/147 36/28 |

OTHER PUBLICATIONS

Engell, Håvard; "Shoe With Sole Providing a Dynamic Heel Support"; U.S. Appl. No. 17/781,414, filed Jun. 1, 2022; 35 pages.

Rustad, Hege; International Search Report; PCT/NO2020/050279; dated Jan. 29, 2021; 3 pages.

* cited by examiner

SHOE WITH SOLE PROVIDING A DYNAMIC FOOT ARCH SUPPORT

TECHNICAL FIELD

The present invention relates to shoes. More specifically, the invention provides a shoe with a sole providing a dynamic and comfortable foot arch support.

BACKGROUND ART

Shoes in many variations have been used for thousands of years. In the modern world, where people mostly walk on hard flat surfaces, various problems related to the foot are widespread. Good shoes can mitigate many of the problems. A traditional walking shoe for healthy feet and healthy guiding of force from the underlayer up into the bones, joints, muscles and connective tissue will typically have a hard sole. Often more than 50% of the sole thickness will be made by rigid, non-elastic material. A different shoe design, probably the state-of-the-art design for mitigating general gait related biomechanical issues, is described and illustrated in the European patent specification EP 2 747 592 B1. In patent publication US 2018/0199665 A1 footwear including lightweight sole structure comprising a plurality of layered structures for providing enhanced comfort, flexibility and performance features are described and illustrated.

In patent publication WO 2009/010078 A1, a molded sole with an anatomical foot support bed is described and illustrated. The molded sole includes a longitudinal arch support along a medial longitudinal section, more pronounced than in the case of a conventional sole and brought forward under the navicular bone (os naviculare), which brings about better anatomical support of the foot.

The navicular bone is a boat-shaped bone located in the top inner or medial side of the longitudinal foot-arch, next to talus and the three cuneiforme bones, medial located to the cuboid bone. The rounded boat-shape of the navicular bone is towards the talus bone. The rounded shape of this joint gives the navicular bone a freedom to rotate both inwards and downwards, related to the talus bone and the longitudinal axes of the foot. The navicular bone is considered to be the most critical bone in the longitudinal arch-construction of the human foot. Measured from the heel in the footprint or along a last of correct size for the footprint, the navicular bone is located on the medial side of the foot arch, extending over the footprint or last a range of about 30%-50%, more specifically about 35%-45%, with the center at about 38%-40%, of the length.

Despite numerous shoe designs and insole designs, a demand still exists for alternative or improved shoe designs providing a dynamic and comfortable foot arch support.

SUMMARY OF INVENTION

The invention provides a shoe with a sole providing a dynamic foot arch support, the shoe comprising a rubber outsole and an upper. The rubber outsole is alternatively termed undersole or outsole rubber. The shoe further comprises a midsole, the midsole comprising a harder elastic material, a softer elastic material, wherein the harder elastic material has elastic hardness in a range 1.3 to 3 times higher, preferably 1.5-2.5 times higher, than the softer elastic material.

The shoe is distinguished in that the harder elastic material is arranged in a band inside the periphery of the midsole, preferably the band extends in a range of 0.1 to 1 times the midsole thickness inwards from the periphery along the sides and heel of the midsole, preferably the band is wider on the medial side than the lateral side in the heel part of the midsole, preferably the band is 1.5 to 4 or 1.5 to 3 or 2 to 3 or 2.5 to 3 times wider on the medial side compared to the lateral side in the heel part of the midsole, wherein the softer elastic material is arranged in the midsole inside the band of the harder elastic material, and the shoe further comprises a support structure arranged below the softer elastic material in direction medial to lateral and positioned from vertically below to 4 cm, or 3 cm in front of the os naviculare bone center of a typical user with feet fitting the shoe size, preferably the support structure has higher elastic hardness than the harder elastic material, and/or a larger vertical dimension on medial side compared to lateral side as seen with the shoe standing on a horizontal surface, providing increased support under the medial side of the foot arch compared to the lateral side of the foot arch.

The sole has harder elasticity under the foot arch and cuneiforme mediale and os naviculare of the user than standard walking shoe soles, but the initial compressive elasticity is soft, providing comfort, due to the softer elastic material facing the foot under the foot arch.

As mentioned, prior art patent publication US 2018/0199665 A1 includes description and illustrations of footwear including a lightweight sole structure comprising a plurality of layered structures. Evident from FIGS. 1 and 12A-12H and described in paragraphs [0031] and [0036], the harder elastic material 160 is arranged below the softer elastic material 130, with flexure plate 150 and strobel member 140 in between. Said strobel member 140 secures the upper to the sole structure, closing for direct contact between said layers 130 and 160. As seen on FIGS. 12A-H of US 2018/0199665 A1, said softer material 130 is on top of the layers of materials 160, 150 and 140 and extends up to elevation far above said harder material 160, as seen with the shoe standing on a horizontal underlayer. From FIG. 12E, it is evident that no effective support structure arranged medial-lateral exist under the os naviculare bone for a user wearing the shoe of US 2018/0199665 A1.

In contrast, an obligatory feature of the shoe of the invention is a support structure arranged below the softer elastic material in direction medial to lateral and positioned from vertically below to 4 cm, or 3 cm in front of the os naviculare bone center of a typical user with feet fitting the shoe size. In addition, harder elastic material is arranged in a band inside the periphery of the midsole and softer elastic material is arranged in the midsole inside the band of harder elastic material. There is no material between the softer and the harder elastic material, said materials are directly adjacent and in direct contact, without other material in between. In the shoe of the invention, the harder elastic material extends to elevation above the softer elastic material as seen with the shoe standing on a horizontal underlayer. In the shoe of the invention, the side support is to a larger extent by having harder elastic material just inside the periphery of the midsole heel and sides, while in the shoe of US 2018/0199665 A1 side support is to a larger extent by building up volume of softer elastic material on the sides of the foot of the user.

Elastic hardness is measured according to ASTM D2240.

For the harder and the softer elastic material, scale A is used, resulting in Shore A values for elastic hardness. For the support structure, Scale A or Scale D is used, resulting in Shore A values or Shore D values for elastic hardness, respectively. The Shore hardness relates to Youngs's modulus of elasticity by relations assumed to be known for the skilled person. The relation is non-linear, and is easiest to find using diagrams, tables or formulas. Youngs's modulus of elasticity relates to resistance against bending, as known according to common general knowledge.

The feature that the harder elastic material has elastic hardness is in a range 1.3 to 3 times higher than the softer elastic material, relates to Shore A values. For example, if the softer elastic material has hardness Shore A of 30, the harder elastic material has Shore A hardness in a range from 39 to 90.

The support structure preferably has a Shore D hardness of 70-90, preferably Shore D of about 80, if the support structure is an inlay or shank, which inlay or shank preferably is integrated or moulded into the softer elastic material. The support structure, if integrated in the rubber outsole or arranged between the rubber outsole and midsole, preferably in the form of an archroller integrated into the rubber outsole, preferably has a hardness Shore A≥70, such as about Shore A 75, or Shore D≥30, such as about Shore D 35.

The shoe preferably comprises an inlay sole, arranged on top of the midsole. However, the shoe can be without an inlay sole. The shoe can be a sandal.

The term midsole means the sole over the rubber outsole, with or without an inlay sole or insole on top.

Measuring from the heel of the shoe, midsole, sole or last, the support structure centerline is in medial-lateral direction, at a distance in a range of about 30-50%, more specifically about 35-45%, such as about 38-40%, of the length from the heel to the front.

The shoe of the invention in general comprises a sole or midsole with more than 50%, 60% or 75% relative soft elastic material through the thickness in the heel region, in the form of the harder elastic material and the softer elastic material.

In the part of the sole under cuneiforme mediale and os naviculare, the sole can however comprise about 50% or even less than 50% of said soft elastic material through the thickness. Thereby, the dynamic elastic stiffness becomes more expressed, increasing progressively under the medial foot arch whilst the heel and preferably also the forefoot has softer elastic stiffness compared to the midfoot. The heel can sink further down, and the forefoot is lower and/or has softer elastic stiffness than under the medial foot arch.

A progressive yet comfortable os navigare and foot arch support is achieved by combining lower elastic hardness material with higher elastic hardness material and more or less rigid material, with a lower elastic hardness material on top, as described and claimed.

Preferably, the support structure is arranged in the rubber outsole, as an integrated part of the rubber outsole. In many preferable embodiments, a further support structure is arranged in the midsole, preferably within the softer elastic material, optionally also within the harder elastic material. Preferably, support structures are arranged in the midsole and the rubber outsole.

The support structure preferably is a conical structure arranged medial-lateral, as seen from the heel of the shoe, the shoe standing on a horizontal surface, with the largest vertical dimension on the medial side. The cross-section shape can be circular, elliptical, half-circle, half-elliptic or polygonal, preferably in any embodiment with largest vertical dimensions on the medial side, to be a conical or conical-like structure. Said support structures can be arranged in the rubber outsole, the midsole or both. The support structure preferably is in substance a cylindrical structure having in substance parallel sides towards toe and heel, respectively, combined with larger vertical cross section dimension on medial side compared to lateral side, with the shoe as standing on a horizontal surface.

In a preferable embodiment of the shoe, the support structure comprises an inlay covering the foot arch of the sole. Preferably, the inlay is trapezoid-like, with the longest side on the medial side. Preferably, the medial side of said inlay is curved, with the convex side facing upwards. Preferably, the inlay is straight/flat in medial-lateral direction but turned clockwise for a right shoe as seen from behind. Thereby, the natural shape of the foot arch is matched by the inlay. The inlay can be said to be a short version of a shank. Preferably, the inlay is twisted in clockwise direction, and/or curved, so as seen for a right foot midsole as seen from behind, the top surface has an angle $\alpha 2$ in a range 1 to 10°, more preferably 2°-10°, or 3°-7° from horizontal. Preferably, the inlay comprises longitudinal ribs along the underside, the ribs are higher on a medial side than on a lateral side, at maximum extension the ribs extend out from the inlay underside at least a distance equal to the thickness of the inlay without said ribs. The inlay is preferably made of a polymer material, preferably polyamide, preferably PA 6 or PA66, preferably the inlay, exclusive any ribs, is 0.5-5, more preferably 1-4 or 2-3 mm thick. Other polymers, such as PE or PET can be used, or carbon fibre or carbon composites, or metal, however, dimensions should be adapted to have similar bending stiffness as a 3 mm thick PA6 inlay in a size 39 shoe.

Preferably, the shoe comprises a shank. Preferably, the shank is embedded, preferably in the softer elastic material, in the midsole from the heel to the forefoot of the intermediate sole. Alternatively, the shank is arranged between layers of the softer elastic material. Preferably, the shank is extending over 60-95% of a last length and extending 60-95% over the last width.

Preferably, the shank is twisted in clockwise direction for a right foot midsole as seen from behind, from the heel to an intermediate part to a position in front of the naviculare bone of a user. Preferably, the twisting is at an angle $\alpha 2$ in a range 1° to 10°, more preferably 2° to 10° or 3° to 7° from horizontal. The shank preferably comprises longitudinal ribs along the shank underside, the ribs extending from the heel and intermediate part to a position in front of the naviculare bone of a user. Preferably, ribs, if present, are higher on a medial side of the shank than on a lateral side of the shank. At maximum extension the ribs preferably extend out from the shank underside at least a distance equal to the thickness of the shank without said ribs. The shank is preferably made of a polymer material, preferably polyamide, preferably PA 6 or PA66. Preferably the shank, exclusive any ribs, is 0.5-3 mm thick. Other polymers, preferably having similar bending stiffness as polyamide, such as PE or PET can be used, or carbon fibre or carbon composites, or metal. The shank preferably has a Shore D hardness of 70-90, preferably a Shore D of about 80. However, dimensions should be adapted to have similar bending stiffness as a 3 mm thick PA6 shank in a size 39 shoe, measured at a shank midpoint medial-lateral in the midfoot region. However, dimensions should preferably be adjusted proportionally, for example a shoe of dimension ⅔ of a size 39 shoe shall preferably have a 2 mm thick PA6 shank. Alternatively, or in addition, the elastic bending stiffness can be adjusted, alone or as combined with adjusting the thickness/dimensions/ribs or no ribs, and/or slots, to provide a shank having a bending stiffness as for a PA 6 or PA66 shank as described. The thickness of the softer elastic material in the midfoot, both above and below the shank, is at least one times the thickness of the shank, allowing perfect bending of the shank over the archroller. Such shank with carefully adapted bending stiffness, embedded in the softer elastic material, combined with an archroller giving support under the midfoot, with increased support under the medial side compared to the lateral side, is the best embodiment of a shoe of the invention.

The midsole preferably comprises polyurethane as the harder elastic material, preferably polyurethane-PU- in a Shore A hardness range 40-80, more preferably Shore A about 60, and a polyurethane as the softer elastic material, preferably polyurethane-PU- in a Shore A hardness range 20-60, more preferably Shore A about 30.

Preferably, at least a part of the midsole top surface is inclined, wherein the midsole is higher on the medial side than on the lateral side in the heel and intermediate part to a position in front of the naviculare bone of a user. Preferably, the inclination, in medial-lateral direction, is at an angle $\alpha 1$ in a range 1° to 7°, more preferably 3° to 5°, from horizontal. In the forefoot area, said top surface preferably is in substance horizontal.

With reference to the inlay or shank rotation $\alpha 2$, and the midsole top surface inclination $\alpha 1$, preferably $\alpha 2 \geq \alpha 1$, more preferably $\alpha 2 > \alpha 1$.

Preferably, the thickness of the softer elastic material over the support structure/shank in the midfoot area of the midsole is lower than the thickness of the softer elastic material over the support structure in the heel area of the midsole. This provides a soft elasticity at initial compression by the foot of the user, but a progressively harder elastic support in the midfoot area of the shoe than in the heel area at further compression, with harder elasticity starting at less compression in the midfoot area compared to the heel area of the midsole, and more expressed on the medial side compared to lateral side.

The harder elastic material is preferably arranged not only around the softer elastic material, as a band laterally around the softer elastic material, but also in a layer below the softer elastic material. The harder elastic material thereby preferably is arranged as a sole shaped "cup", into which cup the softer elastic material and preferably an inlay, preferably a shank, is arranged, for example by molding.

The structure of the shoe provides a combination of comfort and dynamic support, adjustable for specific purposes. How the shoe, and particularly the midsole thereof, shall be designed and built, and why, will be further clarified by the further description below.

The precision in how the shoe can be designed and built for specific effect while retaining comfort, is one reason why the shoe is described as having a dynamic foot arch support. More specifically, the elasticity when compressing the sole initially is soft, guided by the elasticity of the softer elastic material. At further compression, the sole area under the cuneiforme mediale and os naviculare becomes relative more rigid, like a progressive spring. The result is that the heel area and the forefoot area sink further down than the foot arch area below the cuneiforme mediale and os naviculare. The effect varies according to how much the sole already has been compressed, thereby the support is dynamic.

Below a bone structure, such as the calcaneus bone or the navicular bone, means vertically below the centre of the specified bone of a typical user with feet fitting the shoe size, unless otherwise specified.

For left shoes, the definitions with respect to twisting is reversed, as obvious for the skilled person in the art.

The shoes of the invention also include specialized embodiments, such as shoes for persons suffering from diabetes, shoes for small children and shoes for running.

Of particular relevance for persons with diabetes is that the shoe of the invention provides enhanced dynamic weight distribution on the foot, by several features of the shoe. The effect of harder elastic material arranged as a band inside the periphery of the sides and heel of the midsole rather than larger volumes of softer elastic material, is one feature. Inherent guiding of the resultant force of the user to guide a centre of gravity of the foot of the user during a gait to follow a line vertical below the mass or volume centre of the bone structure along the foot, by the outward twisted heel sole and shank/insert and by the midfoot arch support, are further features. The inherent dynamic elasticity, as described explicitly elsewhere, is also a feature. A convex sole in longitudinal direction combined with a concave or flat sole in transverse direction against a flat underlayer, is an additional feature. The result is a semi-unstable shoe by which extreme partial pressure concentrations are avoided and the brain is assumed to receive enhanced continuous signals from the sensory system. The blood circulation is assumed to be enhanced. As a specific example, when standing in a position in balance, the centre of gravity is not static and the foot is not static, sine the sensory system (nerves) detects small deviations in load and stress in the foot tissue, providing signals for adjusting the position of the foot and body, to stay in a balance position by very fast and accurate, often non-conscious, adjustments, often referred to as postural pendulum. The result is a dynamic process of pressure variation on the foot and thereby stimuli for circulation, including the soft tissue of the midfoot. Said process is not masked by large volumes of soft material supporting the foot but enhanced by the structural design of the shoe. For a person with diabetes in an early stage, with feet without significant deep tissue injury, the basic shoe embodiment as defined in the independent claim, and including archroller and shank, may be an optimal shoe.

For persons with diabetes with significant inflammation and/or damages to the deep tissue of the feet, the shoe preferably includes one or more of the features as follows, in any combination:

- increased horizontal dimension of the shoe across the shoe in medial-lateral direction, by 2%, 3%, 5%, 8%, 10% or 15% or above,
- increased vertical dimension of the shoe between sole and upper, by 2%, 3%, 5%, 8%, 10% or 15% or above,
- structural modification for decreasing the contact pressure on the tissue below the toe ball of the first toe (the big toe) of a user with feet fitting the shoe size, by decreasing elastic hardness and/or lower elevation or height or thickness of the sole in an area under the toe ball of the first toe of the user compared to the area around, preferably under the centre point of the toe ball of the first toe of the user or the centre point of the affected tissue and at least 0.5 cm around said centre point, such as 0.5; 1 or 1.5 or 2 or 3 cm around said centre point, and optionally likewise under any of the further metatarsal heads/toe balls, and/or adding a pelotte underneath the metatarsal bones, wherein the contact pressure under the first toe ball of the user is reduced by shifting some of the load to other parts of the forefoot, and
- structural modification for decreasing the contact pressure on the tissue below the heel bone of a user with feet fitting the shoe size, by decreasing elastic hardness and/or lower elevation or height or thickness of the sole in an area under the heel bone of the user compared to the area around, as for instance underneath the medial area of the heelbone (for calcaneus valgus) compared to an optimal, wider pressure distribution underneath the total plantar area of the heel bone. In a preferable embodiment the sole is adjusted under the centre point of the heel bone or the centre point of the affected tissue of the user and at least 1 or 1.5 or 2 or 2.5 or 3 or 4 cm around said point. In addition to the reduced pressure under the heelbone, the dynamic loading of the midfoot area will contribute to further reduction of elastic hardness underneath the heelbone.

The features of increased dimension are adjustments with respect to varying degrees of inflammation. For example, the dimensions are adjusted as compared to European shoe size standard size 39 (ISO/TS 19407:2015, EU or EUR). For other sizes or standards dimensions can be adjusted proportionally.

The structural modification(s) for decreasing the contact pressure, are for adjusting the shoe to reduce contact pressure on typical areas of damage bothering persons with diabetes, as underneath the heelbone and first metatarsal head. A midsole height decrease of at least 0.5 mm, or 1 mm or 2 mm, and/or reduction in elastic stiffness by at least 5, 10 or 15 Shore A units by using softer elastic material in the specified areas under the toe ball of the first toe and/or under the heel bone, and/or modifying a shank to include an opening below the toe ball of the first toe and/or the heel bone, will help. Likewise sole adjustments under the centre point of any affected deep tissue area of a foot of a user are further embodiments of the shoe of the invention.

The physical effects of said adjustments of the shoes are in principle known or predictable by logical reasoning and/or calculations/simulations and/or measurements, but the clinical effect for persons with diabetes cannot be verified until comprehensive scientific testing has taken place. Even though the shoes may help many persons, individual following up and adaptations should always be the rule for persons seriously affected by deep tissue damage caused directly or indirectly by diabetes.

Children shoes, for the very smallest sizes, for example European size 20 and 21, must not necessarily include all obligatory distinguishing features as specified in the characterizing clause of claim 1 as filed. An archroller will however always be present, and a moderately thicker or higher sole medially than laterally, at least in the heel and midfoot area of the sole.

A further embodiment of a shoe of the invention is shoes for running. Running shoes are preferably lighter, preferably by using lighter material, such as a lighter material than standard PU in the midsole. For example, PU strengthened by carbon fibres, such as nano carbon fibres, can be feasible, since the elastic stiffness of a lighter PU grade can be increased with moderate weight increase. Other examples are block copolymers, for example of polyether and polyamide. For a running shoe, the midsole is preferably 5-50% thicker, more preferably 10-30% thicker compared to a standard shoe for walking. The sole thickness is preferably mainly by increased thickness of the softer and the harder elastic material. In addition, the heel region of the sole of the running shoe is preferably relative higher compared to the intermediate and forefoot areas of the sole, compared to a standard shoe for walking, preferably 5-30% higher, wherein the sole is higher in at least the heel region. Preferably, both the heel region and the forefoot region of the sole is thicker compared to a standard shoe for walking, preferably also the "forefoot drop", i.e. the heel thickness minus the forefoot thickness of the sole, is increased. This means that both the heel region and the forefoot region of the sole has increased thickness, preferably also the midfoot region, but preferably with larger increase in thickness in the heel region of the sole. For example, for a typical running shoe of the invention, the heel part of the sole has increased thickness compared to the forefoot part of the sole such as measured under the heel bone centre compared to under the toe ball centre of the first toe of a typical user with feet having size matching the shoe size, for example the thickness difference may increase from 7 or 9 mm to 10 or 11 mm for a size 39 shoe. Such adjustments are within the scope of protection of the independent claim as filed.

DETAILED DESCRIPTION OF THE INVENTION

The obligatory support structure of the shoe of the invention preferably is an archroller. A further support structure preferably is a shank, embedded in the softer elastic material in the midsole, the shank at least extending from the heel forwards to cover the full foot arch. The arch roller preferably is arranged as integrated into the rubber outsole. Alternatively, the archroller is arranged between the rubber outsole and the midsole, always with the shank above.

More specifically, the shoe 1 of the invention preferably comprises an archroller 8 and a shank 6, wherein the archroller is integrated in the rubber outsole or arranged between the rubber outsole and a shank. The archroller is positioned in direction medial to lateral, directly under or slightly in front of the naviculare bone of a typical user with feet fitting the shoe size. Directly under or slightly in front of, in this context means from vertically below to 4 cm, or 0-3, 1-3 or about 2 cm in front of the naviculare bone center as projected vertically down. An alternative description of the location and orientation of the archroller, is that the archroller is under the center of the cuneiforme mediale, extending in medial-lateral direction across the sole, which for a shoe of size 39, as projected vertically down, is about 2.3 cm in front of the center of os naviculare.

Figure 1:
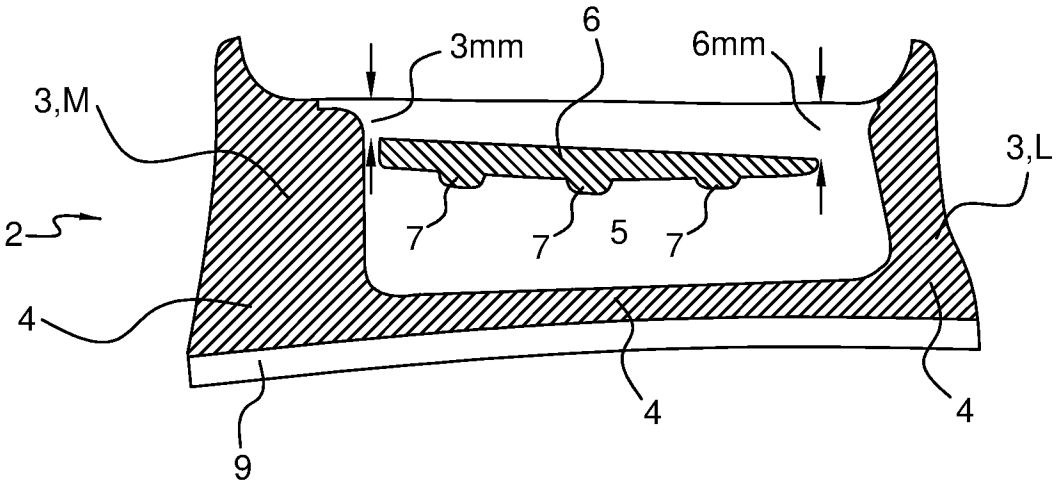
FIG. 1 is a medial-lateral cross section through the heel region of a midsole of a shoe of the invention.

Reference is made to FIG. 1, illustrating a cross section medial to lateral of the heel region of a midsole 2 with rubber outsole 9 of a shoe 1 of the invention, for a right shoe midsole as seen from behind. A band 3 of the harder elastic material 4 extends inwards inside and along the periphery of the midsole. As clearly seen, the band is wider on the medial side M than on the lateral side L. The harder elastic material is also arranged on the lower part of the midsole, which lower part is attached to the rubber outsole. In the midsole, the softer elastic material 5 fills the midsole inside the band and over the lower part. Within the softer elastic material, a shank 6 can clearly be seen in cross section. It can be seen clearly, if the rubber outsole 9 is positioned on a horizontal surface, that the shank is turned clockwise, and that the top surface of the heel part of the midsole, the in substance even or flat parts thereof, excluding rims and edges, is inclined clockwise. The thickness of the softer elastic material over the medial side of the insert is 3 mm, while the thickness of the softer elastic material over the lateral side of the insert is about 5-6 mm, in the illustrated embodiment, at the chosen location for the cross-section. The cross-section location is vertically below a center of the cuboid of a typical user. Measured at a center or centerline of the shank, the thickness of the softer elastic material over the shank is 4.5 mm. Compared to the horizontal, parallel with the underside of the midsole, it can be seen clearly that the shank is twisted clockwise more than the top surface of the midsole is inclined clockwise. The shank is thicker on the medial side than on the lateral side, about 3 mm compared to 1.5 mm, respectively. On the underside of the shank, ribs 7 can be seen extending downwards. The shank is preferably located asymmetrical to the medial side in the softer elastic material with respect to a center of the softer elastic material, at least in the heel region of the midsole.

The specific dimensions, angles and locations are typical examples only, for a size 39 shoe. For other shoe sizes, the dimensions are adjusted linearly. For other embodiments, or for other foot problems, the twisting of the insert and the inclination of the top surface of the midsole and the dimensions and quantities of materials will be different, for example in opposite directions, or to a larger or smaller extent.

Figure 2:
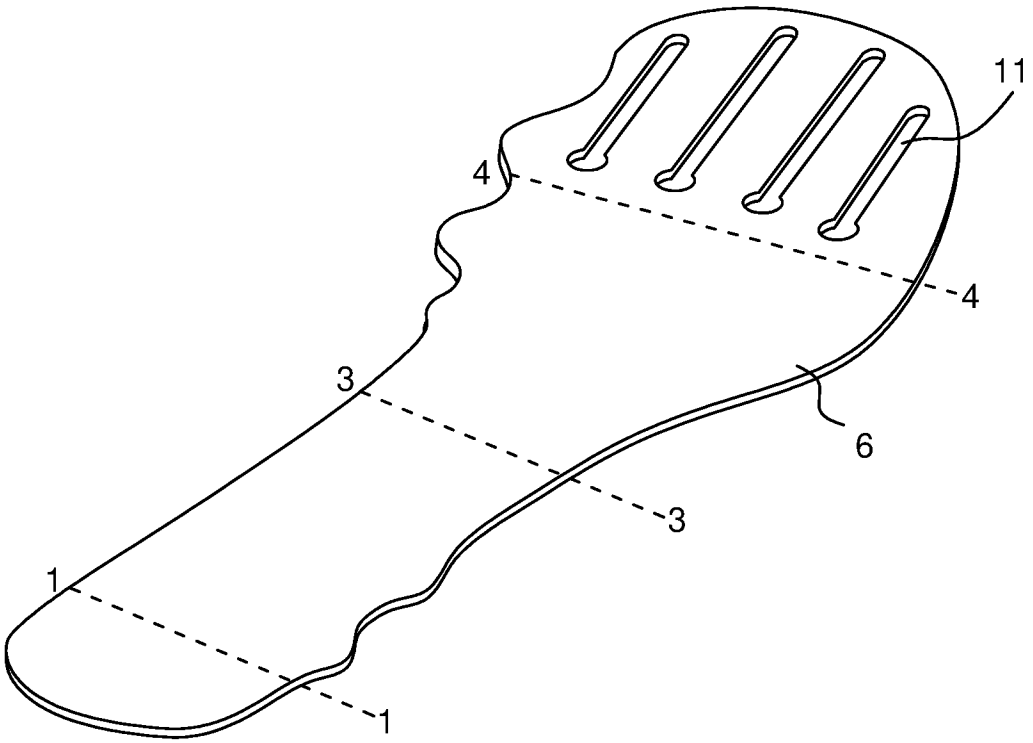
FIG. 2 illustrates an insert of a midsole of a shoe of the invention, in the form of a shank.

Further reference is made to FIG. 2, illustrating a shank 6, for embedding in a midsole in a shoe of the invention. The shank is twisted clockwise in the heel region and the midfoot region but is horizontal in the forefoot region of the shoe. This is easier seen in cross sections on FIGS. 1, 3 and 4, respectively, along the dashed lines 1-1, 3-3 and 4-4, respectively, of FIG. 2. Ribs 7 are visible only on said cross-sections. A support structure, in the form of a shank, preferably comprises holes (not illustrated), as anchoring points for molding, and slots 11 in longitudinal direction in at least the forefoot area, for bending stiffness reduction and anchoring.

Figure 3:
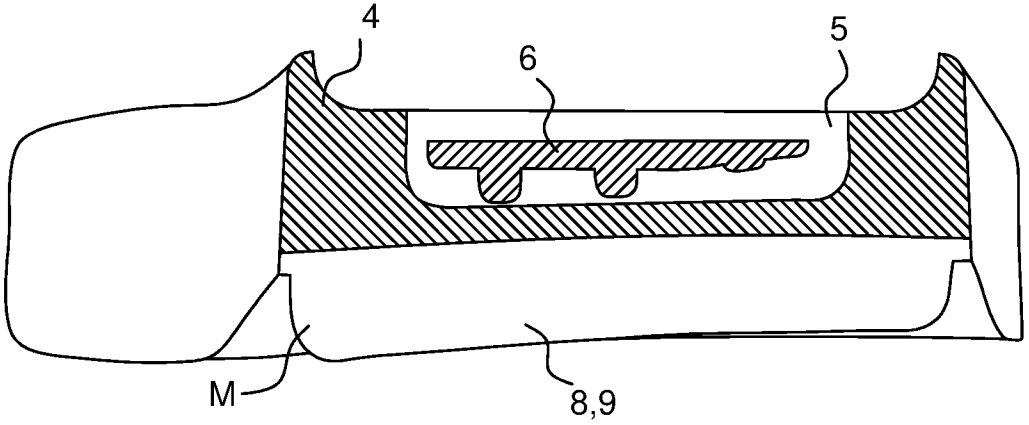
FIG. 3 is a medial-lateral cross section through the midfoot region of a shoe of the invention.

FIG. 3 illustrates a medial-lateral cross section through the midfoot region of a shoe of the invention. The shank, as well as the top surface of the midsole, are twisted clockwise, for a right shoe as seen from behind. The rubber outsole 9 has an archroller 8 integrated. On the medial side M, the archroller will touch the ground before the rest of the rubber outsole. The rubber outsole, and the integrated archroller, preferably has a hardness Shore A≥70, such as about 75, or Shore D≥30, such as about 35. The thickness of the softer elastic material 5 above the shank 6 is 0.6-2; 0.8-1.5; such as about 1 time the thickness of the shank excluding any ribs. The thickness of the softer elastic material 5 below the shank 6 is 0.6-2; 0.8-1.8; such as about 1.3 times the thickness of the shank excluding any ribs. The medial part of the shank is vertically above the medial part of the archroller. The softer and the harder elastic materials, constitute about 30-60%, or about 50% of the sole thickness. Accordingly, the elastic stiffness of the midsole in the midfoot area, particularly on the medial side, is relative higher than in the heel and forefoot area of the sole, since more of the thickness is formed by the relative stiffer material rubber outsole/archroller and shank.

Figure 4:
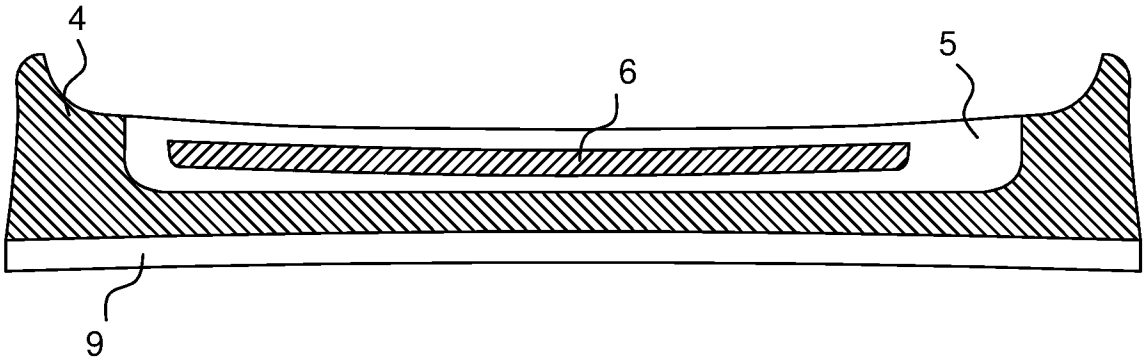
FIG. 4 is a medial-lateral cross section through the forefoot region of a shoe of the invention.

FIG. 4 illustrates a medial-lateral cross section through the forefoot region of a shoe of the invention. The thickness of the softer elastic material 5 above the shank 6 is 0.6-2; 0.7-1; such as about 0.8 times the thickness of the shank excluding any ribs. The thickness of the softer elastic material 5 below the shank 6 is 0.2-1.5; 0.3-1.2; such as about 0.5 times the thickness of the shank excluding any ribs. The sole in the forefoot is thinner, softer and with lower top surface compared to the midfoot part of the sole.

Figure 5:
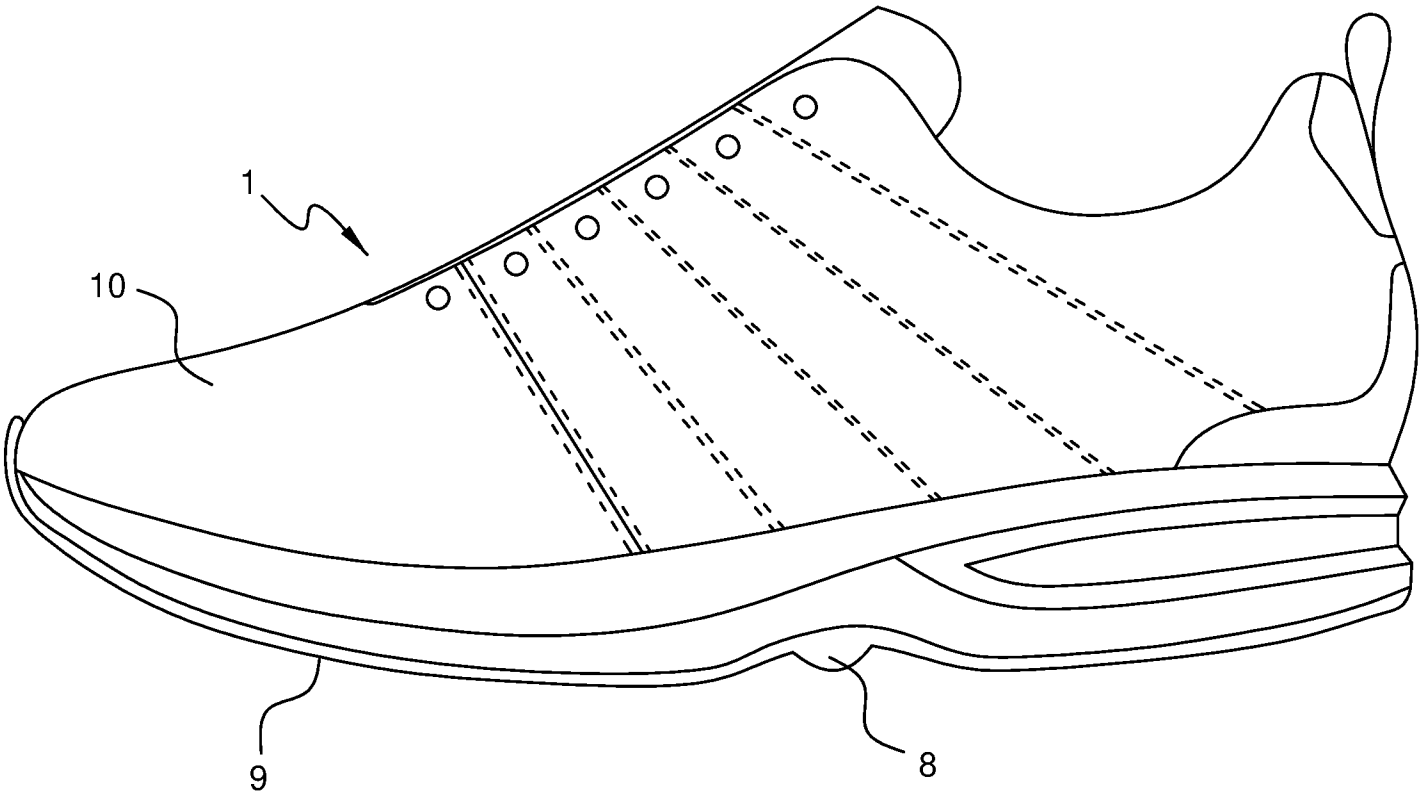
FIG. 5 illustrates a shoe of the invention.
Figure 6:
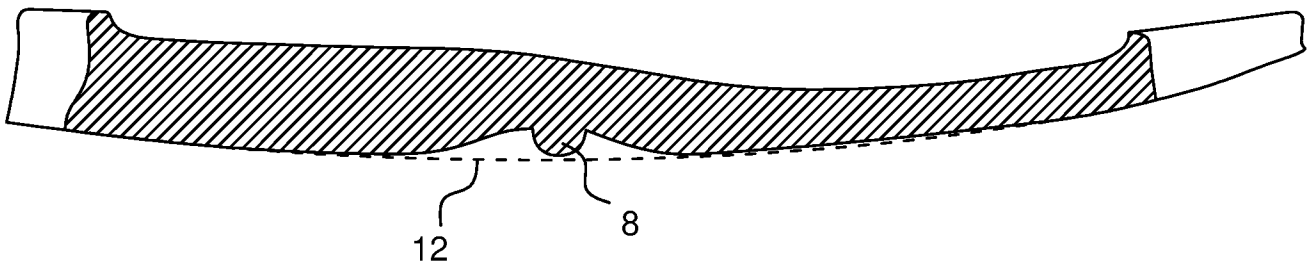
FIG. 6 is a longitudinal section of a midsole of a shoe of the invention, on the lateral side.
Figure 7:
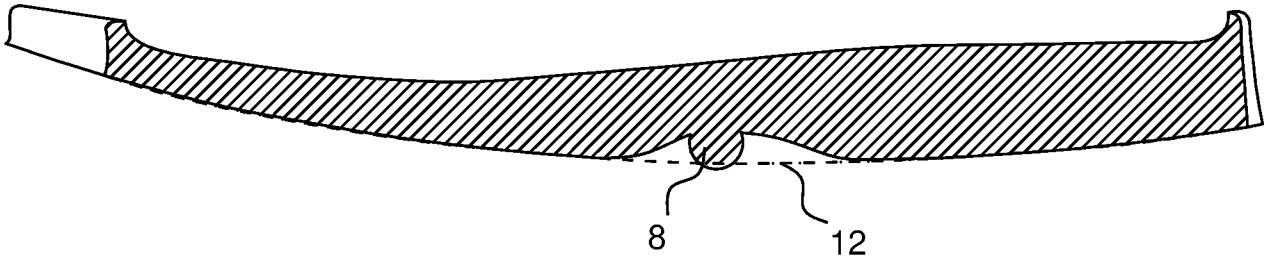
FIG. 7 is a longitudinal section of a midsole of a shoe of the invention, on the medial side.

FIG. 5 illustrates an embodiment of a complete shoe 1 of the invention, with rubber outsole 9, upper 10 and (not visible) insole, seen from the lateral side. The archroller 8, with the shoe standing unloaded on a flat rigid underlayer, will not reach the underlayer on the lateral side as illustrated, but will on the medial side. By studying FIG. 3, the skilled person may recognize that this is illustrated on FIG. 3. FIGS. 6 and 7 illustrate this feature clearly. Typically, 2-6 cm, or preferably 3-5 cm of the medial part of the archroller, dependent on shoe size, is contacted by a flat underlayer by walking. In some embodiments of the shoe of the invention, the archroller is therefore not extending over the full length from medial to lateral of the sole, under the foot arch of the user.

The shoe 1 of the invention preferably comprises an archroller 8 and a shank 6, wherein the archroller preferably is integrated in the rubber outsole or arranged between the rubber outsole and the midsole or shank. The archroller is positioned in direction medial to lateral, directly under or slightly in front of the naviculare bone of a typical user with feet fitting the shoe size. Directly under or slightly in front of, in this context means from vertically below to 4 cm in front of the naviculare bone center. Measured along the sole, from heel to front, this corresponds to 30-50% or 35-45%, more precisely 38-40% of the length from heel to front.

The archroller 8 is a conical structure with respect to cross section dimension in vertical direction with the shoe as standing on a horizontal surface. The horizontal cross section dimension is in substance identical or decreasing along the length medial to lateral of the archroller. Alternatively, the vertical and/or archroller cross-section dimension is changed stepwise.

The archroller can be of massive rubber, at least on the medial side. The medial side of a shank, if present, is arranged over the medial side of the archroller.

Preferably, the archroller is integrated into the rubber outsole. Seen from the below or from the sides, the archroller, as integrated in the rubber outsole, extends further down on the medial side compared to the lateral side, as seen in FIG. 3, which includes the archroller 8 in longitudinal section. A general convex curve 12 in the longitudinal direction of the shoe rubber outsole surface, is crossed by 1-5 mm by the archroller 8 on the medial side, as indicated in FIG. 7. A general convex curve 12 in the longitudinal direction of the shoe rubber outsole surface, is lacking 1-5 mm on the lateral side to reach said general curve 12, as indicated in FIG. 6. FIGS. 6 and 7 are simplified, to illustrate only the described feature, and are longitudinal sections somewhat inside the periphery, near the lateral and medial peripheries, respectively.

The cross dimension of the archroller in longitudinal direction of the shoe is in substance identical or is smaller on lateral side compared to medial side. The archroller, combined with the shank, provides a dynamic and progressive support for the user, in that more pronation provides more support, in that the archroller "lifts" the shank, actually reduce the sinking down of the shank over the archroller, whilst the shank bends down around the archroller in a curve providing comfortable support for the full foot arch, the plantar aponeurosis. The shank must have an appropriate bending stiffness, which is provided by choosing a shank and sole as described. Thereby, so called "naviculare drop" is reduced or prevented. Also, plantar fasciitis, heelspur and similar problems will be reduced or prevented for most users.

«Naviculare drop» is biomechanical terminology meaning that the foot arch is extended and pressed down by the weight of the body of the user. Excessive naviculare drop is reduced or prevented by the present invention. Os naviculare lift or —lifter is alternative terminology describing the effect, meaning os naviculare lift as compared to the os naviculare drop of traditional walking shoes relative to the shoe of the invention.

On the medial side, the archroller reaches the floor, before the general convex undersole surface curve. The archroller 8 has larger vertical dimension, is higher, on the medial side than the lateral side of the shoe, reaching a flat floor before the general convex curve of the undersole surface.

The sole of the shoe of the invention has a soft elasticity at initial compression by the foot of the user, softer than a traditional walking shoe and similar to the initial softness of a sport shoe with extensive damping. At increasing compression, the elasticity becomes progressively harder, particularly on the medial side of heel and midfoot, and more expressed in the midfoot area than the heel area. The effect, when increasing the weight on the heelbone, is that the resistance to further compression is more expressed on the medial side compared to the lateral side. As a consequence, there is a dynamic progressive resistance against too much inward rotation of the heel bone (biomechanically defined as a "heel bone valgus rotation"). The torque creates a clockwise rotation for the right foot seen from behind, effecting the vertical orientation of the heelbone as well as the vertical alignment of the achilles tendon, compared to when using a traditional walking shoe or a sport shoe. Excessive heel bone valgus rotation is thereby reduced or prevented. Likewise, when progressing the step from heel impact to midfoot stance, the foot arch is supported by progressively harder elasticity in the midfoot area, under the foot arch and particularly under the medial side thereof, earlier (at less compression) and harder elasticity, providing "os naviculare lift". Preferably, the shoe comprises a combination of archroller and shank, whereby the archroller provides increasing force from the underlayer up on the shank at increasing compression, most on the medial side of the midfoot, whilst the shank bends and distribute the force along the foot arch. If the detailed design is as here described, said bending of the shank in substance follows the shape of the foot arch.

The invention claimed is:

1. A shoe with a sole providing a dynamic foot arch support, the shoe comprising a rubber outsole and an upper, the shoe further comprises a midsole, the midsole comprising a harder elastic material;

a softer elastic material;

wherein the harder elastic material has elastic hardness in a range of 1.3 to 3 times higher than the softer elastic material;

wherein the harder elastic material is arranged in a band inside a periphery of the midsole, wherein the band is wider on a medial side than a lateral side in a heel part of the midsole;

wherein the softer elastic material is arranged in the midsole inside the band of the harder elastic material;

a support structure arranged below the softer elastic material in a direction medial to lateral and adapted to be positioned from vertically below to 4 cm in front of a naviculare bone center of a user with feet fitting a shoe size; and wherein the support structure has higher elastic hardness than the harder elastic material, with a larger vertical dimension medial compared to lateral as seen with the shoe standing on a horizontal surface, providing increased support under the medial side of a foot arch compared to the lateral side of the foot arch.

2. The shoe according to claim 1, wherein the support structure is arranged in the rubber outsole.

3. The shoe according to claim 1, wherein the support structure is arranged in between the rubber outsole and the midsole.

4. The shoe according to claim 1, comprising a further support structure in the form of a shank, wherein the shank is embedded in the softer elastic material of the midsole from the heel part to a forefoot.

5. The shoe according to claim 4, wherein the shank is twisted in a clockwise direction for a right foot midsole as seen from behind from the heel part to an intermediate part to a position adapted to be in front of the naviculare bone of the user, the twisting is at an angle $\alpha 2$ in a range of 1° to 10° from horizontal, and the shank, exclusive of any ribs, is 0.5-3 mm thick.

6. The shoe according to claim 5, wherein at least a part of a top surface of the midsole is inclined, wherein the midsole is higher on the medial side compared to the lateral side in the heel part and the intermediate part to a position adapted to be in front of the naviculare bone of the user, the inclination is at an angle $\alpha 1$ in a range of 1° to 7° from horizontal.

7. The shoe according to claim 6, wherein $\alpha 2 \geq \alpha 1$.

8. The shoe according to claim 1, wherein:

the harder elastic material has a Shore A hardness range of 40-80; and the softer elastic material has a Shore A hardness range of 20-60.

9. The shoe according to claim 1, wherein a thickness of the softer elastic material over the support structure in a midfoot area of the midsole is lower than a thickness of the softer elastic material over the support structure in the heel part of the midsole.

10. The shoe of claim 1, wherein the band extends in a range of 0.1 to 1 times a thickness of the midsole inwards from the periphery along sides and the heel part of the midsole.

* * * * *